United States Patent [19]

Wheeler

[11] Patent Number: 4,830,382

[45] Date of Patent: May 16, 1989

[54] PORTABLE VOLLEYBALL NET SUPPORT SYSTEM

[75] Inventor: Wesley T. Wheeler, Seattle, Wash.

[73] Assignee: Outaboundz USA Inc., Seattle, Wash.

[21] Appl. No.: 281,983

[22] Filed: Dec. 9, 1988

[51] Int. Cl.[4] ..... A63B 61/04

[52] U.S. Cl. ..... 273/411; 273/29 BC

[58] Field of Search ..... 273/411, 29 B, 29 BC, 273/29 BD, 29 BE, 29 BF, 29 BG

[56] References Cited

U.S. PATENT DOCUMENTS

| | | | |
|---|---|---|---|
| 320,138 | 6/1885 | Jefferson | 273/29 BD |
| 523,912 | 7/1894 | Hopkins | 273/29 BD |
| 1,444,344 | 2/1923 | Gourley | 273/29 BD X |
| 2,527,402 | 10/1950 | Davis | 273/29 BF X |
| 4,253,671 | 3/1981 | Pace | 273/411 |
| 4,415,163 | 11/1983 | Schoenig | 273/411 |

*Primary Examiner*—William H. Grieb

*Attorney, Agent, or Firm*—Christensen, O'Connor, Johnson & Kindness

[57] ABSTRACT

A portable, collapsible system (10) for supporting a volleyball net (20) at desired heights includes a pair of telescoping standard assemblies (12, 14). One end of a support line (18) for supporting the net (20) is attached to the standard assembly (12) with the opposite end of the support line directed to extend downwardly along the standard assembly (14) to engage a one-way cleat (76). The cleat (76) includes a pair of jaw plates (84*a*, 84*b*) positioned relative to each other to define an outwardly flaring line-receiving channel (86). The jaw plates (84*a*, 84*b*) are contoured to define a plurality of spaced apart ridges (90) extending from the bottom of the channel (86) diagonally outwardly and toward the end of the channel (86) opposite from the end at which the support line (18) enters the channel from the net (20). The ridges (90) permit the support line (18) to be pulled through the channel (86) with minimal resistance and then forces the support line downwardly into the channel when the tensioning pull on the support line is released which in turn causes the support line to be tightly gripped by the ridges (90).

21 Claims, 2 Drawing Sheets fig. 2.
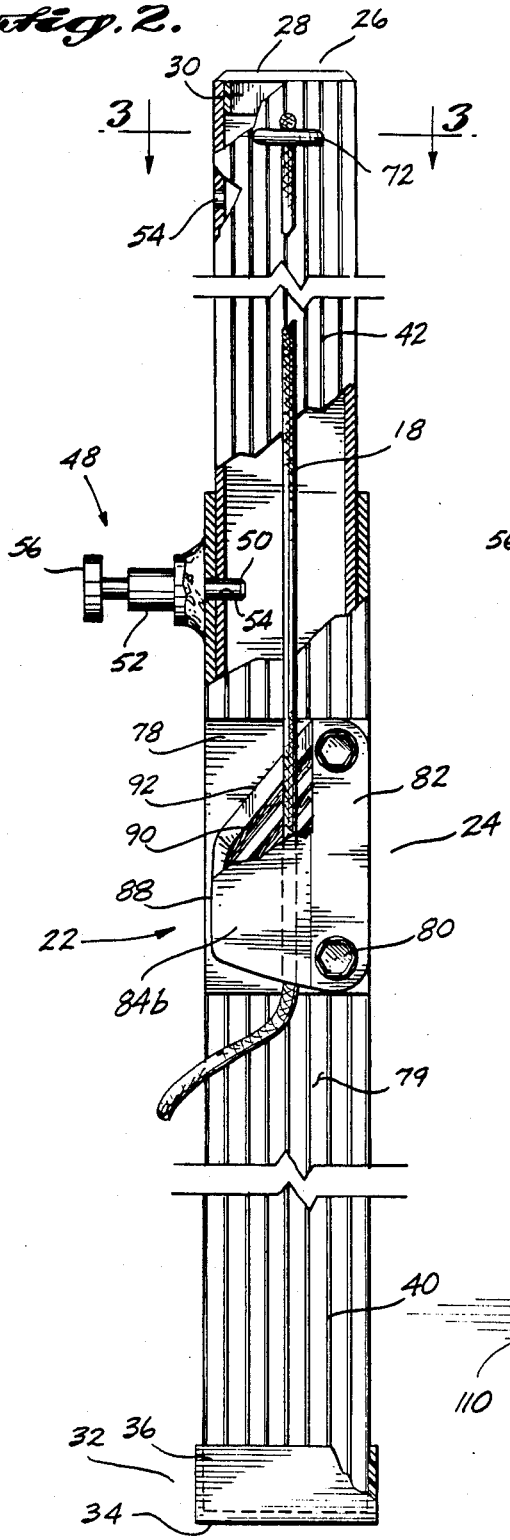
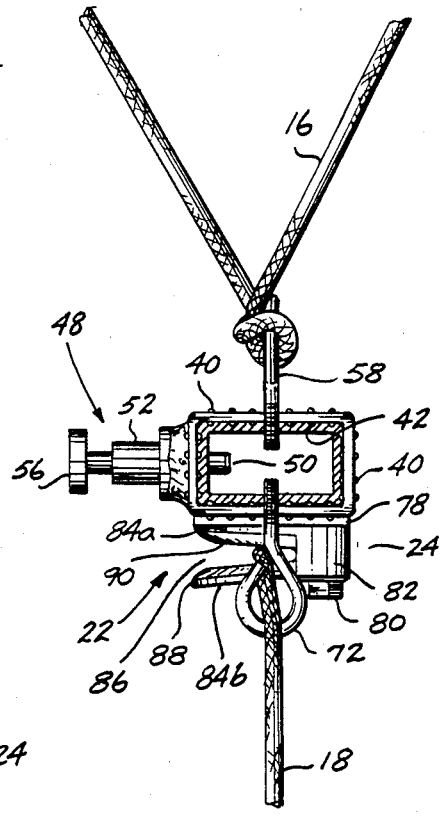
fig. 3.
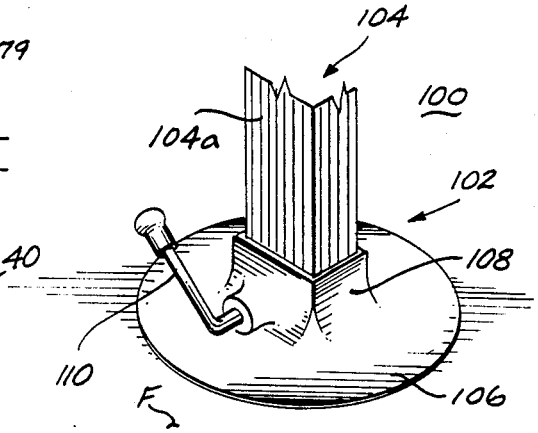
fig. 4.

PORTABLE VOLLEYBALL NET SUPPORT SYSTEM

TECHNICAL FIELD

The present invention relates to equipment for playing volleyball, and more particularly to a collapsible, portable system for supporting a volleyball net in taut condition at desired heights.

BACKGROUND OF THE INVENTION

Volleyball is increasing in popularity as both a competitive and recreational sport. During warm weather, volleyball is commonly played in parks, in back yards, on beaches, and virtually anywhere where a fairly flat surface exists. Recreationally, volleyball is also widely played indoors during inclement weather. Competitively, volleyball is played both in-and out-of-doors by both amature and professional teams.

Typical volleyball equipment, especially for outdoor recreational use, consists of a pair of poles each commonly having a spiked or pointed lower end to engage into the ground, and a line tied between the upper ends of the poles to support a net, with the lower corners of the net being tied to adjacent portions of the poles. Anchor lines are employed to try to maintain the net in taut condition. The anchor lines extend from the top of the poles downwardly and away from the adjacent end of the net.

With the foregoing equipment it is difficult to maintain the support line extending along the top of the net sufficiently tensioned to prevent the net from sagging, especially after being struck by a ball or fallen into by players. To tighten the net, usually one end of the upper support line is loosened and then retied, which is difficult to accomplish due to the height of the top of the net.

A further drawback of the foregoing volleyball equipment is that the poles are rather long. For instance, poles designed to support the net at the 7 foot 11⅝ inch regulation height for men's play are typically over 8 feet in length. Thus, the poles are not easily transportable from place to place in a car or other type of vehicle. Also, due to their lengths, the poles are cumbersome to store when not being used.

Efforts have been made to reduce the bulkiness of the volleyball equipment by constructing the poles in two sections that are detachably connected together by some type of coupling arrangement. For instance, if the pole sections are designed to be telescopically engagable with each other, a typical coupling arrangement consist simply of a threaded cross pin extending through aligned cross holes formed in the overlapping portions of the pole sections to engage a threaded nut, thereby to prevent the pin from becoming disengaged. Because such pole sections are typically constructed from standard sizes of round tubing, the interior of the outer tube is somewhat larger than the exterior of the inner tube, permitting the two tube sections to rock or otherwise move relative to each other, especially if there is any appreciable clearance between the cross pin and the cross holes formed in the two tubes. If the cross pin is tightened in an attempt to reduce the "play" beteween the two tube sections, the torque applied to the nut engaged on the threaded end of the cross pin could easily deform the outer tube into an oblong cross-sectional shape, thereby preventing the two tube sections from being slidable relative to each other.

Another typical manner of locking the two telescoping pole sections relative to each other is through the use of a threaded coupling assembly, having a first member fixed to the end of the outer pole section into which the inner pole section telescopes and a second collar member threadably engaged with the first coupling member to clamp against the inner pole section when the second collar member is tightened relative to the coupling first member. After the two pole sections are extended or retracted to their desired relative engagement, the two coupling members are tightened by rotation relative to each other. A common disadvantage of this type of coupling assembly is that if the two coupling members are overtightened, it is often difficult if not virtually impossible to manually loosen the coupling members. Another significant drawback of this type of coupling assembly is that the threads of the coupling members invariably become rusted, thereby making it extremely difficult to either tighten or loosen the coupling members. Also, if the volleyball equipment is used at the beach, sand invariably becomes lodged between the two coupling members and also between the pole sections and the coupling members to hinder not only the free telescoping movement of the pole sections, but also the rotation of the coupling members relative to each other.

SUMMARY OF THE INVENTION

The foregoing drawbacks of known volleyball equipment are addressed by the present invention which is directed to a collapsible, portable system for supporting a volleyball net in taut condition at desired heights. The system of the present invention includes a pair of telescoping standard assemblies, each having an outer, first, tubular section and an inner, second, tubular section slidably engageable with each other. A locking mechanism is provided for locking the outer and inner tubular sections in selective relative engagement with each other. A support line is extendable between the upper ends of the two standard assemblies for supporting a volleyball net, and a tensioning system is provided for adjusting the tension of the support line. The tensioning system includes a one way clamping mechanism mounted on one of the two standard assemblies for permitting the support line to be drawn through the tensioning mechanism in a direction tending to tighten the support line without imposing a significant drag on the support line, and then tightly gripping the support line when the tensioning pull on the support line is released, thereby preventing retraction movement of the support line within the clamping mechanism that would tend to loosen the support line.

In accordance with a further aspect of the present invention the one-way clamping mechanism includes a jam type cleat mounted on the outer tubular section of one of the standard assemblies, with the cleat composed of a pair of jaw plates having interior faces positioned relative to each other to define a line-receiving channel for receving the support line therein. The interior faces of the jaw plates are contoured to permit the support line to be drawn through the channel with minimal impediment while securely gripping the support line when the tensioning pull on the support line is released.

In another, more specific aspect of the present invention, the interior faces of the jaw plates are contoured to define a plurality of spaced apart ridges that impinge against the support line. The ridges extend along the interior faces of the jaw plate in the direction from the bottom of the receiving channel diagonally relative to the length of the receiving channel toward the end of the channel opposite from which the support line enters the channel from the volleyball net. By this orientation the ridges are also diagonal to the length of the support line engaged within the channel. In addition, the distance across the line-receiving channel separating the ridges of the respective jaw plates increases in the direction extending away from the bottom of the channel. By the foregoing construction the ridges permit the support line to be pulled through the channel with minimal resistance; however, when the tightening pull on the support line is released, the tension in the support line tends to retract the support line through the channel which causes the support line to be forced further into the channel by the ridges which in turn results in a tighter grip on the support line by the ridges. As a consequence, the support line is not allowed to retract relative to the clamping mechanism.

In an additional aspect of the present invention a plurality of longitudinal ribs are spaced apart from each other about the exteriors of the outer sections of the support standard assemblies. The exteriors of the inner sections of the support standard assemblies include longitudinal grooves which preferably are in alignment with corresponding ribs formed in the outer sections of the support standard assemblies.

In accordance with a further aspect of the present invention, the bottom of the support standards may be fitted with a suction foot assembly for permitting the present invention to be utilized indoors. The suction foot assembly includes a socket portion for receiving the lower end of the outer section of the support standard assembly. The suction foot assembly also includes a suction cup for overlying the floor and a mechanism for drawing the central portion of the suction cup upwardly thereby to create a partial vacuum between the suction cup and the floor. As a result, the suction foot assembly is securely anchored to the floor.

BRIEF DESCRIPTION OF THE DRAWINGS

The details of typical embodiments of the present invention will be described in connection with accompanying drawings, in which:

FIG. 2 is an enlarged, fragmentary, side elevational view of the telescoping standard assembly shown in the right-hand side of FIG. 1 with portions broken away, illustrating, inter alia, a system for tensioning the line employed to support the volleyball net;

FIG. 3 is a cross-sectional view of the telescoping standard assembly shown in FIG. 2 taken substantially along lines 3—3 thereof; and, FIG. 4 is a fragmentary isometric view of an alternative embodiment of the present invention adapted for indoor use.

DETAILED DESCRIPTION OF THE PREFERRED EMBODIMENT

Figure 1:
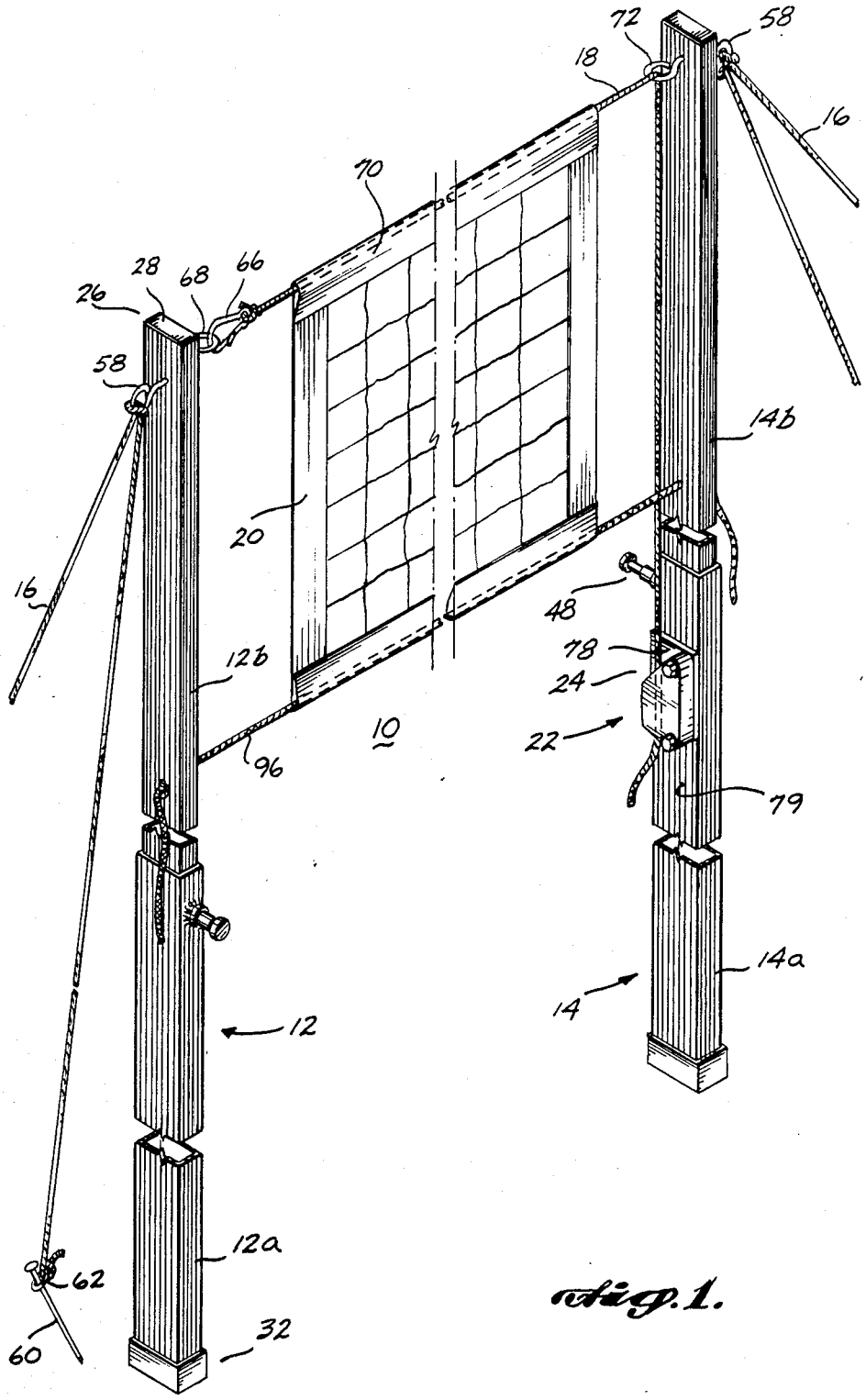
FIG. 1 is an isometric view of a portable support system for a volleyball net constructed according to the present invention and erected for use.

Referring initially to FIG. 1, a portable volleyball net support system 10 includes a pair of telescoping standard assemblies 12 and 14 secured in upright orientation by anchor lines 16. A support line 18 extends between the tops of the standard assemblies 12 and 14 for suspending a volleyball net 20 therefrom. A tensioning system 22 composed in part of a cleat 24, mounted on the standard assembly 14 for receiving the support line 18, is provided for conveniently and selectively tensioning the support line.

Describing the volleyball net support system 10 in more detail, and with additional reference to FIGS. 2 and 3, the telescoping standard assemblies 12 and 14 are composed of outer, rectangular, tubular sections 12*a* and 14*a*, respectively, that closely and slidably receive upwardly extendable inner, rectangular, tubular sections 12*b* and 14*b*, respectively. Preferably, the inner tubular sections 12*b* and 14*b* are sized to closely fit within respective outer tubular sections 12*a* and 14*a* to minimize relative sideways movement between the respective inner and outer tubular sections, while still permitting the two associated tubular sections to freely telescope relative to each other. Although the tubular sections 12*a*, 14*a*, 12*b* , and 14*b* have been illustrated as being rectangular in cross section, it is to be understood that other cross-sectional shapes for tubular sections can be employed, such as square or round, without departing from the spirit or scope of the present invention.

Caps 26 are engaged within the upper or free ends of the inner tubular sections 12*b* and 14*b* to close off the ends of these tubular sections. The caps each include an end plate 28 having an outer perimeter substantially flush with the outer sides of the tubular sections 12*b* and 14*b* and a tubular shank portion 30 snugly recessed within the interior of the tubular sections 12*b* and 14*b*. Feet 32 are also provided to close off the bottoms of the outer tubular sections 12*a* and 14*a*. The feet 32 include a bottom sole plate 34 and an upwardly extending socket section 36 sized to snugly engage over the exterior of the bottom portions of the outer tubular sections 12*a* and 14*a*. If it is desired to increase the bearing area of the feet 32, the size of the sole plates can be enlarged to extend beyond the socket sections 36 of the feet.

As most clearly shown in FIG. 3, the plurality of spaced-apart ribs 40 extend longitudinally along the exterior of the walls of the outer tubular sections 12*a* and 14*a* of the standard assemblies 12 and 14. The ribs 40 cooperatively define a contact plane so that whatever is placed in contact with the outer tubular sections 12*a* and 14*a*at least initially bears against the ribs rather than against the flat wall portions of the outer tubular sections between the ribs. As such, the flat wall portions will less likely be scratched, marred or otherwise damaged during use and transportation, thereby helping to preserve the pleasing appearance of the support system of the present invention. Desirably, the height and width of the ribs 40 are kept to a minimum, but are sufficient for the intended purpose of the ribs. In this regard, preferably the height of the ribs above the outer surface of the tubes 12*a* and 14*a*is from about 0.1 inch to 0.3 inch and the maximum width across the ribs is from about 0.1 to 0.3 inch.

As also shown in FIG. 3, a plurality of spaced-apart, longitudinal grooves 42 extend along the exterior surfaces of the inner sections 12*b* and 14*b* of the standard assemblies 12 and 14. Ideally, the grooves 42 are spaced apart relative to each other to coincide with the locations of the ribs 40 to provide continuity in the exterior appearance of the standard assemblies. Preferably, the grooves 42 are formed in a depth and width sufficient to permit dirt, sand and similar foreign material to pass through the grooves, particularly when the sections of the standard assemblies 12 and 14 are telescoped relative to each other or when the standard assemblies are shaken or lightly vibrated. As will be appreciated, the grooves 42 reduce the likelihood that the sections of the standard assemblies will be "jammed" or "frozen" by foreign materials. Ideally, to perform the foregoing function, the grooves are formed in a depth of from about 0.01 to 0.03 inch deep and a width of from about 0.01 to 0.03 inch.

Preferably, the inner and outer sections of the standard assemblies 12 and 14 are composed of high-strength but lightweight material capable of safely withstanding the loads imposed on the standard assemblies during rugged use while also allowing the standard assemblies, when collapsed, to be conveniently transported together, for instance, in a storage bag, not shown. One material meeting these requirements is aluminum, which has the additional advantages of being noncorrosive and resistant to weathering. Other types of materials that may be used to construct the inner and outer tubular sections of the standard assemblies 12 and 14, though perhaps less optimum than aluminum, include titanium, magnesium, steel and high-strength plastics. The high-strength plastics desirably may be reinforced with extremely high tensile strength fibers, such as graphite, KEVLAR or boron.

The inner sections **12*b* and 14*b* of the standard assemblies 12 and 14 are held in position relative to the outer sections 12*a* and 14*a* by a locking mechanism 48 composed of a plunger pin 50 disposed within an outer casing 52 mounted transversely to upper end portions of the outer tubular sections 12*a* and 14*a* by welding or other appropriate method. The leading end of the plunger pin 50 extends through a clearance opening formed in outer tubular sections 12*a* and 14*a* to engage within one of a series of close-fitting holes 54 provided in the adjacent wall of the inner tubular sections 12*b* and 14*b*. The plunger pin is biased into forward or engaged position by a compression spring, not shown, disposed within the outer casing 52. An enlarged, manually graspable head 56 is attached to the outward end of the plunger pin 54 to enable the plunger pin to be conveniently retracted when telescoping the standard assemblies. Preferably, the holes 54 are located along the length of the inner tubular sections so that the standard assemblies may be raised to the appropriate elevations to support the net 20 at the regulation heights for men's and women's volleyball competition. Ideally, one hole 54 is also located adjacent the upper, free end of the inner tubular sections 12*b* and 14*b* so that the standard assemblies 12 and 14 may be locked in collapsed position by the locking mechanism 48**.

Althrough a preferred embodiment of the locking mechanism 48 has been described and illustrated, it is to be understood that the locking mechanism may be constructed in other manners.

Referring specifically to FIGS. 1 and 3, the standard assemblies 12 and 14 are each supported in upright orientation by a support line 18 extending through an eye 68 or similar type of member mounted on the upper end portions of the inner tubular sections **12*b* and 14*b*. The free, lower ends of the anchor line 16 are secured to spikes or stakes 60 driven into the ground. A ring 62 or similar member may be attached to the ends of the anchor line 16 for convenient engagement with the spikes 60**, or the spikes can be formed with an integral ring at their upper ends.

Next, additionally referring to FIG. 2, one end of the support line 18 is attached to the upper end of the standard assembly 12 by the use of a carabiner, snaphook or similar attachment member 66 engaged with an eye 68 or similar member mounted on the upper end portion of the inner tubular section **12*b* opposite the eye 58. The net 20 typically is constructed with an upper hem 70 through which the support line 18 is threaded. An eye 72, corresponding to the eye 68, is mounted on the upper end of the inner tubular section 14*b* for receiving therethrough the portion of the support line 18 approaching from the opposite standard assembly 14 and for directing the support line downwardly to extend along the standard assembly 14 and engage with a jam cleat 24, which constitutes part of the tensioning system 22. The jam cleat 24 is secured to a flat faceplate 78 mounted on the exterior of the wall 79 of the outer tubular section 14*a* at the upper end portion of the outer tubular section 14*a*. To this end, fasteners, for instance, threaded bolts 80, extend through clearance holes formed in the web or base portion 82 of the jam cleat 24 to engage aligned, threaded holes formed in the faceplate 78. The faceplate 78 may be welded or otherwise securely mounted to the outer tubular section 14*a*** by other appropriate methods.

Continuing to refer specifically to FIG. 2, the jam cleat 24 is constructed with a pair of spaced-apart walls or jaw plates **84*a* and 84*b* that extend outwardly from the web portion 82 to define a groove or channel 86 extending therebetween. The jaw plates are configured and oriented so that in cross section the channel 86 is formed in a truncated V-shape, with the width across the channel being substantially narrower at the web 82 than at the "top" of the channel defined by the edges 88 of the jaw plates 84*a* and 84*b*. The interior surfaces of the jaw plates 84*a* and 84*b* are contoured to frictionally engage the support line 18 and preferably permit the support line to be readily drawn through the channel 86** as the support line is being tensioned, while preventing the support line from retracting relative to the jam cleat when the tensioning pull on the support line is released.

In one preferred embodiment of the present invention, the interior surfaces of the jaw plates **84*a* and 84*b* are contured to define a plurality of spaced-apart ridges or elongated teeth 90 that extend from the bottom of the channel 86, i.e., from the web portion 82, diagonally outwardly toward the edges 88 and downwardly in the direction toward the free end of the support line 18 (toward the end of the channel 86 opposite from the end of the channel that the support line enters the channel from the net 20). As such, the ridges 90 are disposed diagonally to the length of the portion of the support line 18 disposed within the channel 86. It will be appreciated that by the foregoing construction of the jam cleat 24 the support line 18 may be readily drawn or pulled through the channel 86 without a significant level of drag to apply the desired tension level to the support line. Thereafter, the line may be simply pushed toward web 82 of the jam cleat 24 and released, whereupon the tension in the support line tends to cause the support line to retract through the channel; however, the ridges 90 impinging on the support line 18 force the support line to move along the ridges and extend deeper within the channel 86, in turn causing the ridges to more tightly clamp the support line. As a result, the support line is tightly held by the jam cleat and prevented from loosening, even if a high-tension load is placed on the support line, for instance, by a player falling or running into the net 20. When it is desired to release the support line 18, the free end of the support line extending below the jam cleat 24 is simply pulled in the direction away from the web 82, thereby to disengage the support line from the ridges 90 and allow the support line to retract through the channel 86**.

To facilitate the initial threading or placing of the support line into the channel 86 and also to eliminate sharp edges, the upper corner of the jam cleat 86 may be beveled at 92, as shown in FIG. 2. Although not essential, the bevel 92 may be substantially parallel with the ridges 90 formed in the interior of the jaw plates 84*a* and 84*b*. Also, preferably the anchor lines 16 and support line 18 are composed and constructed to carry high level loads without elongating under the loads. As a non-limiting example, the lines 16 and 18 can be composed of double braided nylon.

Although one particular embodiment of the locking mechanism 48 has been illustrated and described above, it is to be understood that other types of locking mechanisms may be employed in conjunction with the present invention. Such other locking mechanisms may utilize jam cleats that function similarly to the jam cleat 24.

The support system 10 of the present invention is set up for use by initially threading the anchor lines 16 through the eyes 58 at the tops of the standard assemblies 12 and 14. The standard assemblies are extended to desired lengths and the ends of the anchor lines are secured to spikes 60 driven into the ground. One end of the support line 18, which has been threaded through the top hem 70 of net 20, is connected to the eye 68 at the top of the standard assembly 12 located opposite the eye 58. At the opposite end of net 20, the support line 18 is threaded through the eye 72. The standard assemblies 12 and 14 are then placed in upright position. The support line 18 is tightened by drawing the support line downwardly through the channel 86 of the jam cleat 24 until the net 20 is in the desired taut condition. The ends of line 96 extend through the lower hem of the net 20 and are threaded through cross holes formed in the inner tubular sections 12*b* and 14*b* and then tied off. The support system 10 is conveniently disassembled by simply reversing the foregoing procedure.

It will be appreciated that, by the above-described construction of the present invention, the volleyball net support system 10 may be quickly and conveniently set up and then subsequently disassembled and stored in a compact package, for instance, in a carrying bag, not shown, that fits in the trunk of a car or other vehicle. Moreover, the support system 10 of the present invention is durable and capable of withstanding rugged use. Further, the support system 10 securely supports a volleyball net at regulation height without sagging.

FIG. 4 illustrates an alternative embodiment 100 of the present invention wherein the standard assemblies are adapted for indoor use. As shown in FIG. 4, a suction foot assembly 102 is attached to the bottom of the illustrated standard assembly 104. The suction foot assembly includes a suction cup portion 106 and an upwardly extending socket portion 108 adapted to receive the bottom of the outer section 104*a* of the standard assembly 104. The suction foot assembly 102 has a manually rotatable lever 110, which, when actuated, tends to lift the central portion of the suction cup 106 upwardly relative to the floor F, thereby to create a partial vacuum between the suction cup and the floor. As a result, the suction foot assembly is rigidly anchored to the floor. It will be appreciated that, by this construction, the support system 100 may be conveniently utilized indoors without requiring any special connection or attachment arrangement between the bottom of the standard assembly 104 and the floor F.

With the exception of the foregoing, the support system 100 is constructed essentially in the same manner as support system 10, thereby providing the same advantages made possible by the support system 10, discussed above.

Although preferred embodiments of support systems for vollyball nets have been illustrated and described, it will be appreciated by those skilled in the art that various changes, additions, and omissions may be made in the form and detail of the foregoing description and drawings without departing from the spirit or essential characteristics of the present invention. The particular embodiments of the vollyball net support systems 10 and 100, described above, are therefore to be considered in all respects as illustrative and not restrictive. The scope of the present invention is as set forth in the appended claims, rather than being limited to the examples of the volleyball net support systems 10 and 100 set forth in the foregoing description.

The embodiments of the invention in which an exclusive property or privilege is claimed are defined as follows:

1. A portable system for supporting a volleyball net, comprising:

(a) a pair of support standards;

(b) a support line extending between the two standards for supporting the volleyball net; and, (c) a tensioning system for adjusting the tension of the support line, the tensioning system comprising:

(i) means for connecting a first end portion of the support line to one of the two standards;

(ii) means on the second of the two standards for directing the support line approaching the second standard from the first standard downwardly along the length of the second standard; and, (iii) one-way clamping means mounted on the second standard for permitting the second end portion of the line to be drawn through the tensioning means in a direction tending to tighten the support line and tightly gripping the support line when the tensioning pull on the support line is released, thereby to prevent retraction of the support line through the clamping means.

2. A portable system for supporting a volleyball net according to claim 1, wherein the support standards each comprise:

a tubular first section;

a tubular second section telescopically engagable within the first section; and, means for locking the first and second sections of the standard in selective relative engagement with each other.

3. A portable system for supporting a volleyball net according to claim 2, wherein the locking means comprise a retractable, spring-loaded plunger pin mounted on the first section of the support standard, the plunger pin being engagable within a selected opening formed in the second section of the support standard.

4. A portable system for supporting a volleyball net according to claim 2, wherein the first section of the support standard has ribs spaced about the exterior of and extending longitudinally of the first section of the support standard.

5. A portable system for supporting a volleyball net according to claim 4, wherein the exterior of the second section of the support standard has portions defining grooves extending longitudinally of the second section of the support standard.

6. A portable system for supporting a volleyball net according to claim 2, wherein the second section of the support standard has grooves formed in the outer surface thereof and extending longitudinally thereof.

7. A portable system for supporting a volleyball net according to claim 2, wherein the first and second section of the support standard are rectangular in cross section.

8. A portable system for supporting a volleyball net according to claim 1, wherein the one-way clamping means comprises:

a pair of jaw plates having interior faces positioned relative to each other to define a line-receiving channel for receiving the second end portion of the support line therein; and friction means associated with the jaw plates to permit the second end portion of the support line to be drawn through the line-receiving channel with minimal impediment and frictionally gripping line when the tensioning pull on the support line is released.

9. A portable system for supporting a volleyball net according to claim 8, wherein the friction means comprise a plurality of spaced apart ridges to impinge against the support line, the ridges extending along the interior faces of the jaw plates in the direction from the bottom of the line-receiving channel diagonally relative to the length of the lien-receiving channel toward the second end of the support line opposite from which the support line enters the line-receiving channel from the net, whereby the ridges are also diagonal to the length of the second end portion of the support line engaged in the line-receiving channel.

10. A portable system for supporting a volleyball net according to claim 9, wherein the distance across the line-receiving channel separating the ridges of the respective jaw plates increases in the away from the bottom of the line-receiving channel.

11. A portable system for supporting a volleyball net according to claim 9, wherein the corresponding ridges of the two jaw plates are disposed in substantial alignment with each other.

12. A portable system for supporting a volleyball net according to claim 8, wherein:

the support standards each have a first tubular section, a second section telescopically engagable withn the first section, and means for locking the first and second sections relative engagement with each other; and, the one-way clamping means is mounted on the second section of one of the two support standards.

13. A portable system for supporting a volleyball net according to claim 12, wherein the second section of the support standard has portions defining longitudinal grooves formed in the exterior of the second section.

14. A portable system for supporting a volleyball net according to claim 12, wherein the first section of the support standard has portions defining ribs extending longitudinally along the exterior of the first section.

15. A collapsible volleyball system for supporting a volleyball net at desired elevations, comprising:

(a) first and second telescoping standard assemblies, each having:

an outer, first tubular section;

an inner, second tubular section slidably engagable within a corresponding outer tubular section; and, locking means for locking corresponding outer and inner tubular sections together at selected relative engagements with each other;

(b) a support line connectable between the first and second standard assemblies to support the net, the support line having a first end attachable to the first standard assembly and a second end portion; and, (c) means for tensioning the support line to a desired tension level, comprising:

means mounted on the second standard assembly for directing the portion of the support line aproaching the second standard assembly from the first standard assembly in a direction downwardly along the length of the second standard assembly; and, one-way clamping means mounted on the second standard assembly for permitting the second end portion of the support line to be drawn through the clamping means in a direction tending to tighten the support line and subsequently tightly holding the second end portion of the support line when the tightening pull on the support line is released, thereby to prevent retraction of the support line.

16. A collapsible volleyball system according to claim 15, wherein the one-way clamping means comprises a pair of jaw plates having interior faces disposed relative to each other to define a channel for receiving the second end portion of the support line therein, the interior faces being contured to permit the support line to be drawn through the channel without signficant drag as the support line is being tensioned and then frictionally gripping the support line when the tightening pull on the support line is released.

17. A collapsible volleyball system according to claim 16, wherein the interior faces of the jaw plates are contoured to define a plurality of spaced-apart ridges extending the jaw plate interior faces from the bottom of the channel diagonally relative to the length of the channel in the direction toward the top of the channel and toward the end of the channel opposite to the end of the channel at which the support line enters the channel from the net.

18. A collapsible volleyball system according to claim 17, wherein the distance across the channel separating the ridges of the jaw plate interior faces decreases in a direction from the top of the channel to the bottom of the channel to define a generally wedge-shaped, cross-sectional profile.

19. A collapsible volleyball system according to claim 15, wherein the inner tubular sections of the standard assemblies have longitudinal grooves formed in the exteriors thereof.

20. A collapsible volleyball system according to claim 19, wherein the outer tubular sections of the standard assemblies have longitudinal ribs extending along the exteriors thereof.

21. A collapsible volleyball system according to claim 15, wherein the inner and outer tubular sections of the standard assemblies are rectangular in cross section.

* * * * *

UNITED STATES PATENT AND TRADEMARK OFFICE

CERTIFICATE OF CORRECTION

PATENT NO. : 4,830,382

DATED : May 16, 1989

INVENTOR(S) : Wesley T. Wheeler

It is certified that error appears in the above-identified patent and that said Letters Patent is hereby corrected as shown below:

Column 1, lines 65 and 66, "beteween" should be --between--.

Column 3, line 53, "inter alia" should be --inter alia--.
Column 4, line 45, "14aat" should be --14a at--.
Column 4, line 55, "14ais" should be --14a is--.
Column 5, line 52, "Althrough" should be --Although--.
Column 5, line 59, "68" should be --58--.

Column 9, lines 9 and 10, "section" should be --sections--.
Column 9, line 22, after "gripping" insert "the support".
Column 9, line 31, "lien" should be --line--.
Column 9, line 40, after "the" (first occurrence) insert --direction--.
Column 10, line 17, "aproaching" should be --approaching--.
Column 10, line 34, "contured" should be --contoured--.

Signed and Sealed this

Seventeenth Day of April, 1990

*Attest:*

HARRY F. MANBECK, JR.

*Attesting Officer*

*Commissioner of Patents and Trademarks*